United States Patent [19]

Asakura et al.

[11] Patent Number: 4,669,897

[45] Date of Patent: Jun. 2, 1987

[54] DOT MATRIX PRINTER CAPABLE OF VARYING CHARACTER SIZE

[75] Inventors: Osamu Asakura, Tokyo; Mineo Nozaki, Kawasaki; Masasumi Nagashima, Yokosuka; Yoshio Uchikata, Yokohama, all of Japan

[73] Assignee: Canon Kabushiki Kaisha, Tokyo, Japan

[21] Appl. No.: 767,251

[22] Filed: Aug. 20, 1985

Related U.S. Application Data

[63] Continuation of Ser. No. 583,291, Feb. 28, 1984, abandoned, which is a continuation of Ser. No. 392,339, Jun. 25, 1982, abandoned.

[30] Foreign Application Priority Data

Jul. 7, 1981 [JP] Japan ..... 56-106402

[51] Int. Cl.[4] ..... B41J 3/12

[52] U.S. Cl. ..... 400/121; 400/120; 400/303; 400/322

[58] Field of Search ..... 400/120, 303, 320, 322, 400/328, 121

[56] References Cited

U.S. PATENT DOCUMENTS

| | | | |
|---|---|---|---|
| 4,024,447 | 5/1977 | Epstein | 400/120 X |
| 4,024,941 | 5/1977 | Sekikawa et al. | 400/903 X |
| 4,030,587 | 6/1977 | Walker | 400/120 X |
| 4,113,391 | 9/1978 | Minowa | 400/120 |
| 4,213,714 | 7/1980 | Jones et al. | 400/322 X |
| 4,247,214 | 1/1981 | Swan | 400/120 X |
| 4,278,359 | 7/1981 | Weikel | 400/303 X |

FOREIGN PATENT DOCUMENTS

| | | | |
|---|---|---|---|
| 137241 | 10/1979 | Japan | 400/303 |
| 113585 | 9/1980 | Japan | 400/903 |
| 67275 | 6/1981 | Japan | 400/303 |
| 1297566 | 2/1970 | United Kingdom | 400/322 |

*Primary Examiner*—Paul T. Sewell

*Attorney, Agent, or Firm*—Fitzpatrick, Cella, Harper & Scinto

[57] ABSTRACT

A dot matrix printer comprises a head comprising a plurality of printing elements, a motor for moving the head, an oscillation source for supplying pulses for driving the motor, and varying means for varying the spacing between dots printed by the head at an integer ratio corresponding to the driving pulses put out from the oscillation source.

7 Claims, 7 Drawing Figures

DOT MATRIX PRINTER CAPABLE OF VARYING CHARACTER SIZE

This application is a continuation of application Ser. No. 583,291 filed Feb. 28, 1984, now abandoned, which is a continuation of application Ser. No. 392,339 filed June 25, 1982, now abandoned.

BACKGROUND OF THE INVENTION

1. Field of the Invention

This invention relates to a dot matrix printer for printing characters, symbols or the like constituted by dots, and more particularly to a dot matrix printer capable of varying the printing size of the characters, symbols or the like.

2. Description of the Prior Art

Dot matrix printers have generally effected single character size printing. Where printing at two or more different character sizes has been desired, one dot pitch has not been varied but the number of dots used in one character has been varied that is, the character font has been varied to change the character size. Therefore, the character size has been limited to the sizes such as ½ or twice the basic size for which the character font can be made by subjecting a character generator of the basic character pattern to a simple processing. Also, where characters of the other sizes have been desired, it has been necessary to prepare character generators for special size characters in addition to the character generator of the basic size. There is a method comprising varying the amount of feed of the printing head to vary the character size, but this method has required the feeding mechanism to be provided with a complex mechanism such as a speed change gear or a clutch and therefore has rarely been put into practical use from the viewpoints of reliability and cost.

SUMMARY OF THE INVENTION

It is an object of the present invention to provide a dot matrix printer which is capable of printing a plurality of character sizes at an accurate pitch without using a complex mechanism.

It is another object of the present invention to provide a dot matrix printer which is capable of varying the pitch between dots forming a character, a symbol or the like at an integer ratio corresponding to the number of driving pulses for a pulse motor for driving a printing head, thereby varying the character size.

Other objects of the present invention will become apparent from the following detailed description of an embodiment thereof taken in conjunction with the accompanying drawings.

DESCRIPTION OF THE PREFERRED EMBODIMENT

Figure 1:
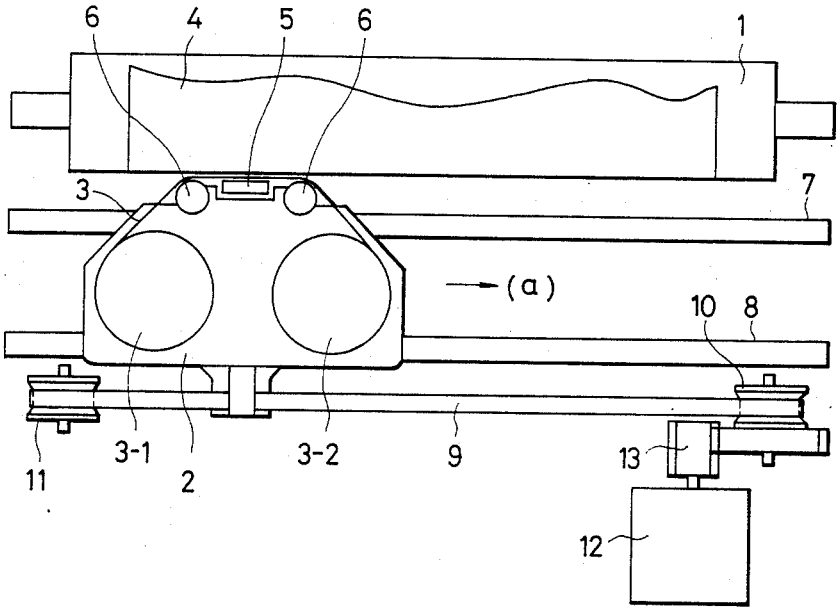
FIG. 1 is a plan view of a dot matrix printer which is an embodiment of the present invention.
Figure 3:
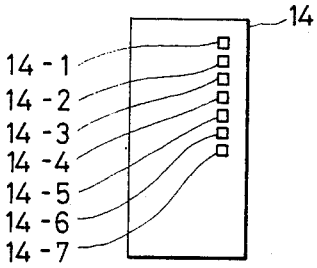
FIG. 3 shows the construction of a thermal head.

An embodiment of the present invention will hereinafter be described by reference to the drawings. Referring to FIG. 1 which is a plan view of a dot matrix printer which is an embodiment of the present invention, reference numeral 1 designates a platen holding printing paper 4 by its outer periphery. Designated by 2 is a carriage supported by a guide shaft 7 and a guide rail 8 parallel to the platen and movable parallel to the platen 1. The carriage 2 is provided with a printing head 5 and an ink ribbon guide roller 6. Denoted by 3 is an ink ribbon. Ink ribbon reels 3-1 and 3-2 on which the ink ribbon 3 is wound may be set on the carriage 2 with the ink ribbon guide rollers 6 interposed therebetween. The carriage 2 is engaged with a carriage driving belt 9 passed over a drive pulley 10 and an idle pulley 11, and is adapted to effect printing while being moved in the direction of arrow (a) parallel to the platen 1 by a carriage driving motor (stepping motor) 12 through the driving belt 9. In the present embodiment, a printing head 5 is a thermal head provided with vertically arranged seven heating resistor elements 14 as shown in FIG. 3, and the ink ribbon 3 is a thermal transfer ink ribbon in which heat-meltable ink coated on the polyester base of the ink ribbon 3 is transferred onto the printing paper in a desired pattern by heating of the thermal head thereby effecting printing.

Figure 2:
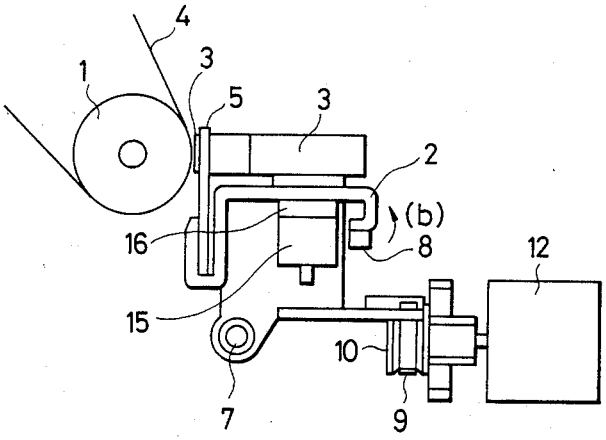
FIG. 2 is a side cross-sectional view thereof.

FIG. 2 is a side cross-sectional view of the dot matrix printer shown in FIG. 1.

Description will now be made of the printing operation of the dot matrix printer constructed as described above. First, printing data is applied as input to a printer driving control device (not shown) and, when the preparation for printing is completed, the printing operation is started. The carriage driving motor 12 is first driven and, when the carriage 2 is moved to a position whereat it is desired to effect printing of the printing paper 4, the guide rail 8 is pivotally moved in the direction of arrow (b) indicated in FIG. 2 by a solenoid, not shown, and the printing head 5 is urged against the printing paper 4 on the platen 1 with the ink ribbon 3 interposed therebetween. Thereupon, power is supplied to a resistor element 14 of the thermal head 5 which corresponds to a desired character pattern, and the ink on the ink ribbon 3 is transferred to the printing paper 4.

Then, the carriage driving motor 12 is driven by a predetermined number of steps and the carriage 2 is moved by one dot pitch, whereby printing of the next dot line is effected.

During the movement of the carriage, the ink ribbon 3 is held between the ink ribbon guide rollers 6 and the platen 1 and therefore is fed by an amount corresponding to the amount of movement of the carriage 2. As shown in FIG. 2, an ink ribbon take-up motor 15 is coupled to the lower portion of the ink ribbon reels through a friction clutch 16 so that the portion of the ink ribbon fed by the ink ribbon guide rollers 6 and left over on the ink ribbon reel 3-1 side is taken up onto the ink ribbon reel 3-2.

Figure 4:
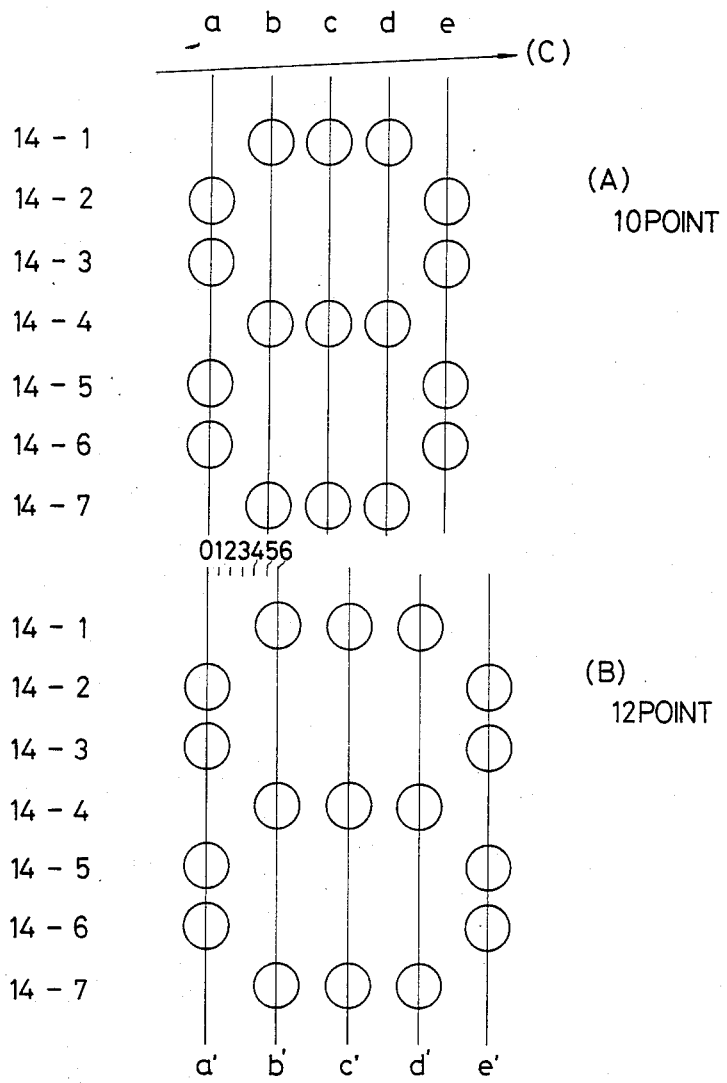
FIGS. 4(A) and 4(B) show the character patterns according to the present invention.

FIG. 4 shows the character pattern of numeral "8", FIG. 4(A) shows a 10 point size character pattern and FIG. 4(B) showing a 12 point size character pattern. In the printing of 10 point "8", the carriage 2 is moved in the direction of arrow (c) and when the dot line of the heating resistor elements 14 of the thermal head 5 has come to position a, the carriage driving motor 12 is stopped and power is supplied to the elements 14-2, 14-3, 14-5 and 14-6 of the resistor elements 14, whereby printing is effected. When the printing at the position a which is the first dot line is completed, the carriage driving motor 12 is driven by five pulses, so that the carriage 2 is moved to position b through the drive pulley 10 and the belt 9 and stopped thereat. At the position b, power is supplied to the elements 14-1, 14-4 and 14-7 of the heating resistor elements 14 of the thermal head 5, whereby printing is effected. Likewise, printing proceeds to c→d→e.

Where the printing as described above is to be effected at 12 point, after the printing at position a′ has been completed, the carriage driving motor 12 is driven by six pulses, whereby the printing at position b′ is effected. Thereafter, the carriage is likewise moved at one dot pitch by six pulses until the printing at position e′ is completed, whereupon printing of "8" is terminated.

As described above, one pulse drive amount of the carriage driving motor 12 is set to an integer ratio of 5:6 between 10 point and 12 point, that is, so that the motor is driven by 5 pulses for 10 point and by 6 pulses for 12 point. Likewise, in the present embodiment, dot pitch 7 pulses results in printing at 14 point and 4 pulses results in printing at 8 point.

In the present embodiment, the driving of the carriage driving motor 12 is effected at double 1-2 phase excitation of a four-phase stepping motor.

Figure 5:
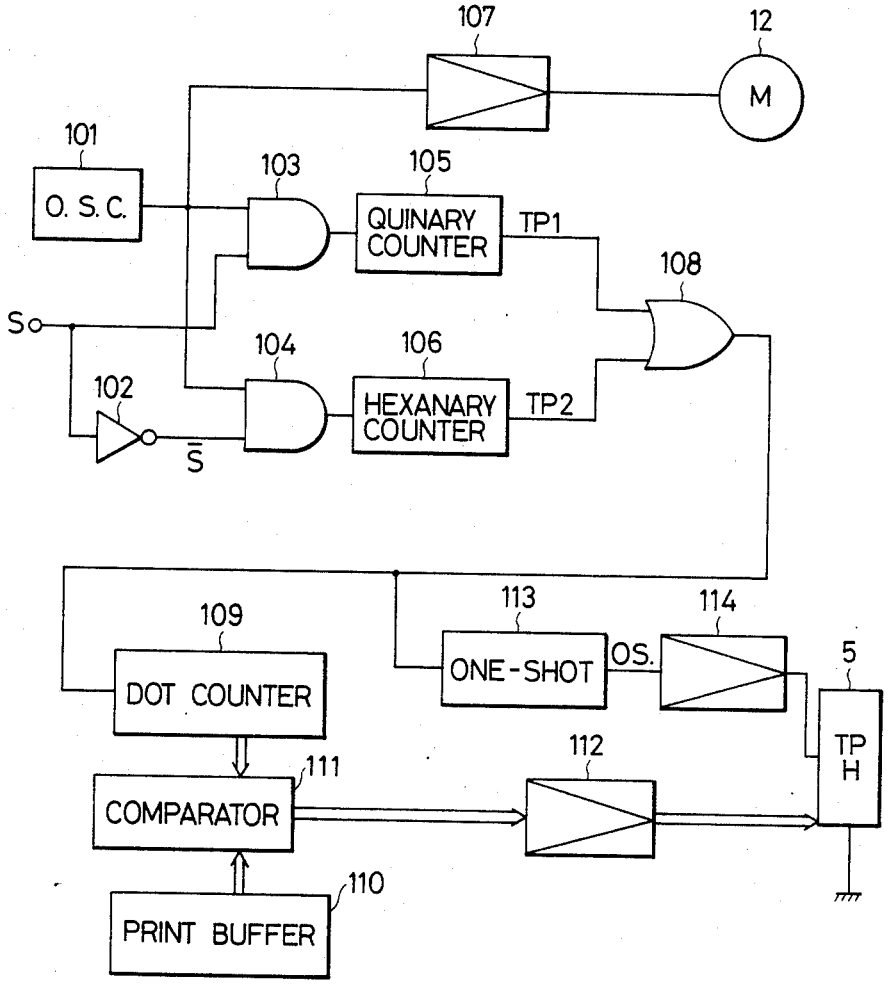
FIG. 5 is a block diagram of the driving circuit of the dot matrix printer shown in FIGS. 1 and 2.
Figure 6:
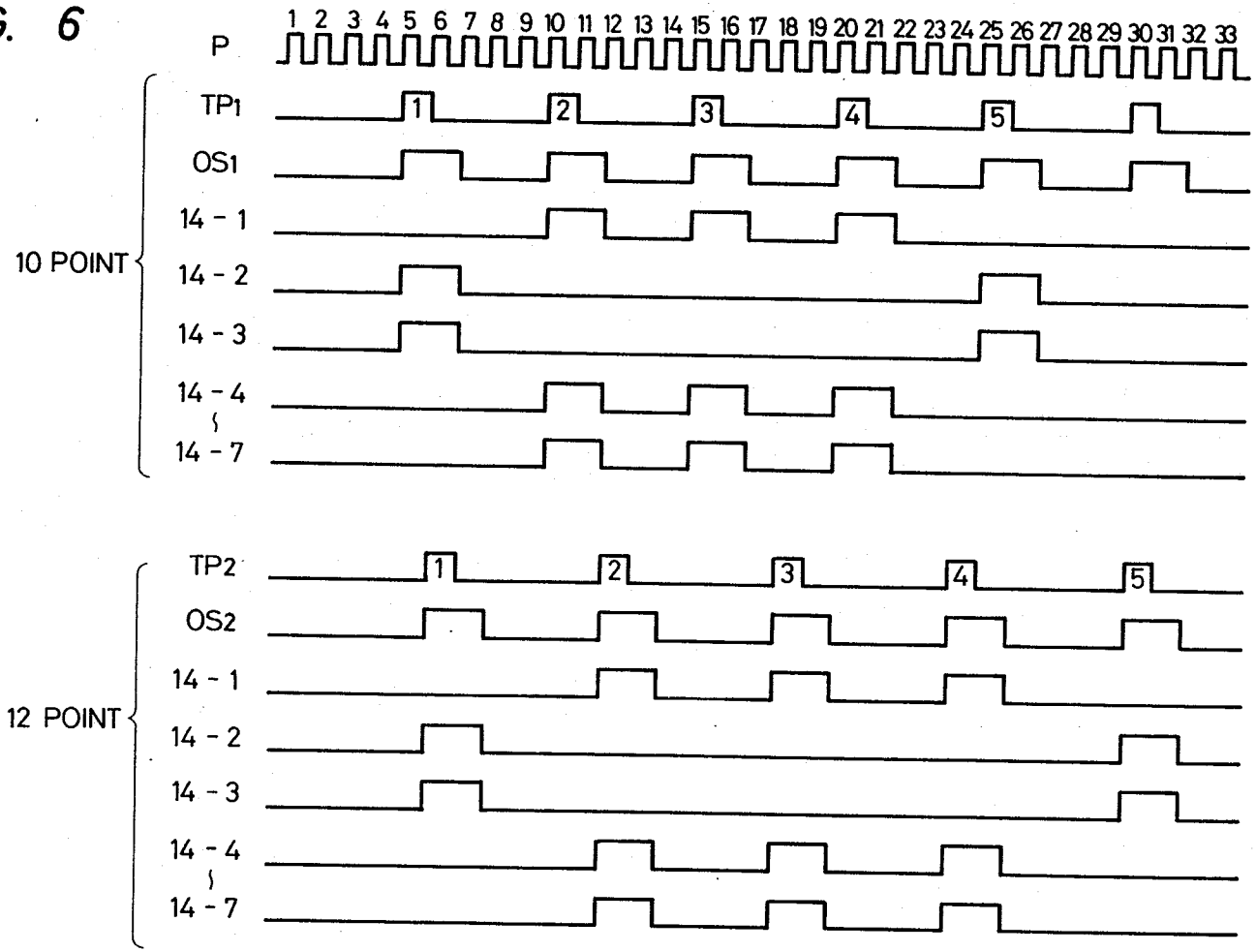
FIG. 6 is a timing chart thereof.

FIG. 5 is a block diagram of a circuit for driving the dot matrix printer shown in FIGS. 1–3, and the construction and operation thereof will hereinafter be described. Designated by 101 is an oscillator (OSC) which puts out the basic pulse P as shown in FIG. 6. The basic pulse P put out from the oscillator (OSC) 101 is delivered to AND circuits 103, 104 while, at the same time, it is put out to a stepping motor driving circuit 107 which rotates the carriage driving motor 12 which in turn drives the carriage 2. A switch signal S for setting the character size to one of 10 point and 12 point is applied as input to the AND circuit 103, while a signal $\overline{S}$ passed through an inverter 102 is applied as input to the AND circuit 104. When the switch signal S is "1" (the character size is set to 10 point), the basic pulse P put out from the oscillator (OSC) 101 is put out to a quinary counter 105 through the AND circuit 103, and when the switch signal S is "0" (the character size is set to 12 point), that is, when the signal $\overline{S}$ passed through the inverter 102 is $\overline{S}=1$, the basic pulse P is put out to a hexanary counter 106 through the AND circuit 104. The quinary counter 105, when the basic pulse P is applied as input thereto, step-advances its content one by one and when its content reaches 5, it puts out a signal $TP_1$, shown in the timing chart of FIG. 6, and when the basic pulse P is applied as input to the hexanary counter 106, it step-advances its content one by one and when its content reaches 6, it puts out a signal $TP_2$ shown in the timing chart. The signal $TP_1$ or $TP_2$ put out from the quinary counter 105 or the hexanary counter 106 as described above is supplied to a dot counter 109 through an OR gate 108. This dot counter 109 counts the position of the carriage 2 from its start of operation in the dot number of 10 point or 12 point, and a comparator 111 compares the printing information stored in a print buffer 110 with the content of the dot counter and delivers printing information of each line to operate a thermal head driving circuit 112. Simultaneously therewith, the signal $TP_1$ put out from the quinary counter 105 or the signal $TP_2$ put out from the hexanary counter 106 is delivered to a one-shot circuit 113 which sets the time range of power supply to the thermal head 5, and the one-shot circuit 113 puts out a signal $OS_1$ or $OS_2$, shown in the timing chart of FIG. 6, to a head power source ON-OFF circuit 114, which starts the power supply to the heating resistor elements 14 of the thermal head 5 driven by the thermal head driving circuit 112, whereby printing is effected on the printing paper 4. The timing chart of FIG. 6 covers the case where the character size is 10 point and the case where the character size is 12 point.

In the foregoing, the case where the character size is 10 point and the case where the character size is 12 point have been described, but if a quaternary counter is additionally provided, printing at 8 point character size will of course be possible, and if a septenary counter is additionally provided, printing at 14 point character size will of course be possible. In the present embodiment, an example using the thermal transfer printing system has been shown, but the present invention is applicable to ordinary dot matrix printers such as thermal printers, wire dot printers, etc.

What we claim is:

1. A dot matrix character printer capable of varying character size, comprising:

a head having a plurality of printing elements;

a step motor for moving said head a predetermined distance for each step of said motor;

pulse supply means for generating periodic pulses;

first counter means for counting the periodic pulses and for generating first and second signals, said first counter means having a first mode of operation for producing a first signal each time $n_1$ periodic pulses have been counted and a second mode of operation for producing a second signal each time $n_2$ periodic pulses have been counted, wherein $n_1$ and $n_2$ each are greater than one;

mode selecting means for selecting one of the first and second modes of operation in accordance with the character size;

second counter means for counting either the first or second signals, depending on the selected mode of operation;

data storage means for storing data to be printed by said head in the form of a dot matrix;

output means for comparing the count value of said second counter means with the content of said data storage means and for providing data stored in said data storage means corresponding to the count of said second counter means;

head driving means for causing said head to effect a printing operation to print the data provided by said output means in response either to each of the first signals or to each of the second signals depending on the selected mode of operation; and motor driving means for driving said step motor one step in response to each periodic pulse generated by said pulse generating means to move said head a different number of the predetermined distances between each printing operation, depending on the selected mode of operation.

2. The printer according to claim 1, wherein said head is a thermal head and wherein the plurality of printing elements are a plurality of heating elements arranged in a line on said head.

3. The printer according to claim 1, wherein said mode selecting means includes said pulse supply means, gate means disposed at said first counter means, and switch signal output means for producing a switch signal for controlling said gate means.

4. A character printer capable of varying character size, comprising:

displaceable head means for printing characters;

pulse generating means for generating periodic pulses;

output producing means having a first mode of operation for producing an output each time $n_1$ periodic pulses have been counted and a second mode of operation for producing an output each time $n_2$ periodic pulses have been counted, wherein $n_1$ and $n_2$ each are greater than one;

mode selecting means for selecting one of the first and second modes of operation in accordance with a desired character size;

counter means for counting a selected output of said output producing means, depending on the selected mode of operation;

memory means for storing a plurality of print data;

driving means for producing print data in accordance with the count of said counter means and the print data stored in said memory means and for driving said head means to perform a printing operation in accordance with the print data in response to each output of said output producing means selected for counting in accordance with the selected mode of operation; and displacing means for displacing said head means in response to the periodic pulses from said pulse generating means a different distance between each printing operation depending on the selected mode of operation.

5. The printer according to claim 4, wherein said head means is a dot matrix printing head.

6. A character printer capable of varying character size, comprising:

a head having a plurality of printing elements;

a step motor for moving said head a predetermined distance for each step of said motor;

signal generating means for generating periodic first signals;

output generating means having a first mode of operation for generating a second signal each time $n_1$ periodic first signals have been counted and a second mode of operation for generating a third signal each time $n_2$ periodic first signals have been counted, wherein $n_1$ and $n_2$ each are greater than one;

mode selecting means for selecting one of the first and second modes in accordance with a desired character size;

head driving means for driving said printing elements of said head to effect printing operations at the interval of one of the second and third signals depending on the selected mode of operation; and motor driving means for driving said step motor one step in response to each periodic first signal generated by said signal generating means to move said head a different number of the predetermined distances between each printing operation depending on the selected mode of operation.

7. The printer according to claim 6, further comprising data storage means for storing data to be printed by said head in the form of a dot matrix, wherein said head driving means includes data output means for selectively producing data of each line of said dot matrix from said data storage means in response to one of the second and third signals.

* * * * *